US006158564A

United States Patent [19]

Derelanko

[11] Patent Number: 6,158,564

[45] Date of Patent: Dec. 12, 2000

[54] ICE CUBE GUIDE FOR USE WITH REFRIGERATOR/FREEZER AUTOMATIC ICE CUBE MAKERS

[76] Inventor: Michael J. Derelanko, 117 Robertsville Rd., Manalapan, N.J. 07726

[21] Appl. No.: 09/436,640

[22] Filed: Nov. 9, 1999

[51] Int. Cl.[7] ..... B65G 11/00

[52] U.S. Cl. ..... 193/2 R

[58] Field of Search ..... 193/2 R, 4; 141/98, 141/391, 331, 334

[56] References Cited

U.S. PATENT DOCUMENTS 4,458,960 7/1984 Dunst ..... 312/236 X
5,148,842 9/1992 Boust ..... 193/2 R

*Primary Examiner*—James R. Bidwell
*Attorney, Agent, or Firm*—Charles T. Brodsky

[57] ABSTRACT

The ice cube guide of the invention is in the nature of a chute (tubular or otherwise) having a cross-section to allow it to be held comfortably by hand either directly or with a handle, having top and bottom open ends, with the top end being cut at an angle to allow the chute to be removably inserted into a compartment of a freezer door ice dispensing mechanism in a manner such that the top end of the chute is situated directly below the opening from which ice cubes are dispensed, and with the lower end extending beyond and outside the outer edge of the bottom of the ice dispenser compartment, to permit ice cubes falling from the dispenser's opening to be directed into the opening of the chute, and from there through the chute to exit from the bottom of the hand-held chute outside the ice dispenser compartment.

11 Claims, 3 Drawing Sheets

ICE CUBE GUIDE FOR USE WITH REFRIGERATOR/FREEZER AUTOMATIC ICE CUBE MAKERS

FIELD OF THE INVENTION

This invention relates to refrigerator/freezer automatic ice cube makers and, more particularly, to a device for simplifying the gathering of dispensed ice cubes for use.

BACKGROUND OF THE INVENTION

As is well known and understood, many refrigerator/freezers sold today are equipped with an automatic ice cube maker to supply ice cubes on demand through an opening which is readily accessible through a compartment located on the outside of the freezer door. Such compartment—typically of dimensions of approximately 8" high by 11" wide by 4½" deep—is generally located on the external side of the freezer door which opens into the room. At the top of the recessed compartment is an opening which is functionally connected to the storage bin of the ice making unit located within the freezer itself. As generally designed, near the rear of the compartment, directly under such opening, is a button or lever which, when depressed, activates the ice maker to dispense ice cubes through the opening of the compartment, directed to fall into a vessel placed directly below the opening. Such button or lever is actuated as the vessel which is to receive the ice cubes is put in contact with it, and pushed. In such manner, a person is able to load ice cubes into a glass tumbler without opening the freezer door, and prevents warm air from entering the freezer compartment—and unnecessarily wasting energy.

Because the compartment located in the freezer door is of a size generally intended for use with a glass tumbler, problems arise when trying to fill a vessel of a height usually more than 8 inches. A person wishing to add ice cubes to a larger vessel (such as an ice bucket or a small ice chest) then, is generally unable to do this directly from the compartment as such larger vessel will not fit into the compartment beneath the opening, and will not be able to actuate the operating button or lever. Such a person wishing to add ice cubes to this type of larger vessel would have to open the freezer door for access to the ice storage bin, and either scoop ice cubes from the bin by hand into the ice bucket, ice chest, etc.—or remove the storage bin entirely from the freezer and dump its ice cubes directly into the vessel. Not only does this require opening the freezer door (and allowing warm air into the freezer to waste energy and deleteriously affect its operation) but frequently leads to dropping the ice cubes on the floor when trying to scoop them out of the bin by hand.

SUMMARY OF THE INVENTION

As will become clear hereinafter, the ice cube guide of the present invention embodies a hand-held chute which allows a person wishing to fill these ice buckets, ice chests, or other vessels that do not fit into the standard ice compartment on the door to continue to utilize the automatic ice cube maker nevertheless. As set forth, the chute—preferably constructed of a rigid material such as plastic or metal—incorporates a first open, top end arranged to fit into the door compartment directly under the ice cube dispenser opening; at the same time, a second open, bottom end of the chute extends beyond the lower edge of the compartment in a manner to direct any ice cube that is captured at the top end to be directed out the bottom end, downwardly and beyond the confines of the ice dispenser compartment. As will also be seen, the top end of the chute incorporates a protruding front edge which contacts the operating button or lever of the ice cube dispenser when inserted, such that when pressed against the button or lever, actuates the ice dispenser mechanism to drop the ice cubes into the opening of the chute. In this manner, a person wishing to fill an ice bucket, ice chest, etc. is able to do so by holding the ice bucket or ice chest (as an example) outside the ice dispenser compartment with one hand, while holding the chute in the other hand either directly (in accordance with one embodiment of the invention) or by means of an optional handle (on a second embodiment of the invention). With the bottom end of the chute being held above the ice bucket or ice chest and the top end inserted into the ice dispenser compartment under the ice cube dispensing opening, a pushing of the protruding edge of the top of the chute against the operating button or lever causes the ice cubes to drop into the top of the chute and to be directed into the ice bucket or chest to be filled.

As will become clear from the description that follows, to accomplish this simply and easily, the chute may be selected of a length of at least 5–6 inches. The first open, top end of the chute is cut at an angle of approximately 35° with the horizontal so as to allow the front of the chute to seat substantially below the point at which the ice cubes are dispensed from the compartment. In one embodiment, a chute according to the invention is in the form of a tube, having open top and bottom ends and closed, continuous sides along its length. In a second embodiment, the chute has its sides open and discontinuous.

The ice cube guide described in U.S. Pat. No. 4,102,660 (Beckett et als) and the ice cube funnel of U.S Pat. No. 5,261,468 (Scheel) will be seen quite different from the invention herein—in that neither is concerned with trying to collect in a larger vessel than an 8 inch glass tumbler ice cubes dispensed from an automatic ice cube maker, and in that the ice cube funnel of Scheel is concerned with collecting ice cubes from a tray and directing them into a glass for drinking.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE DRAWINGS

Figure 1:
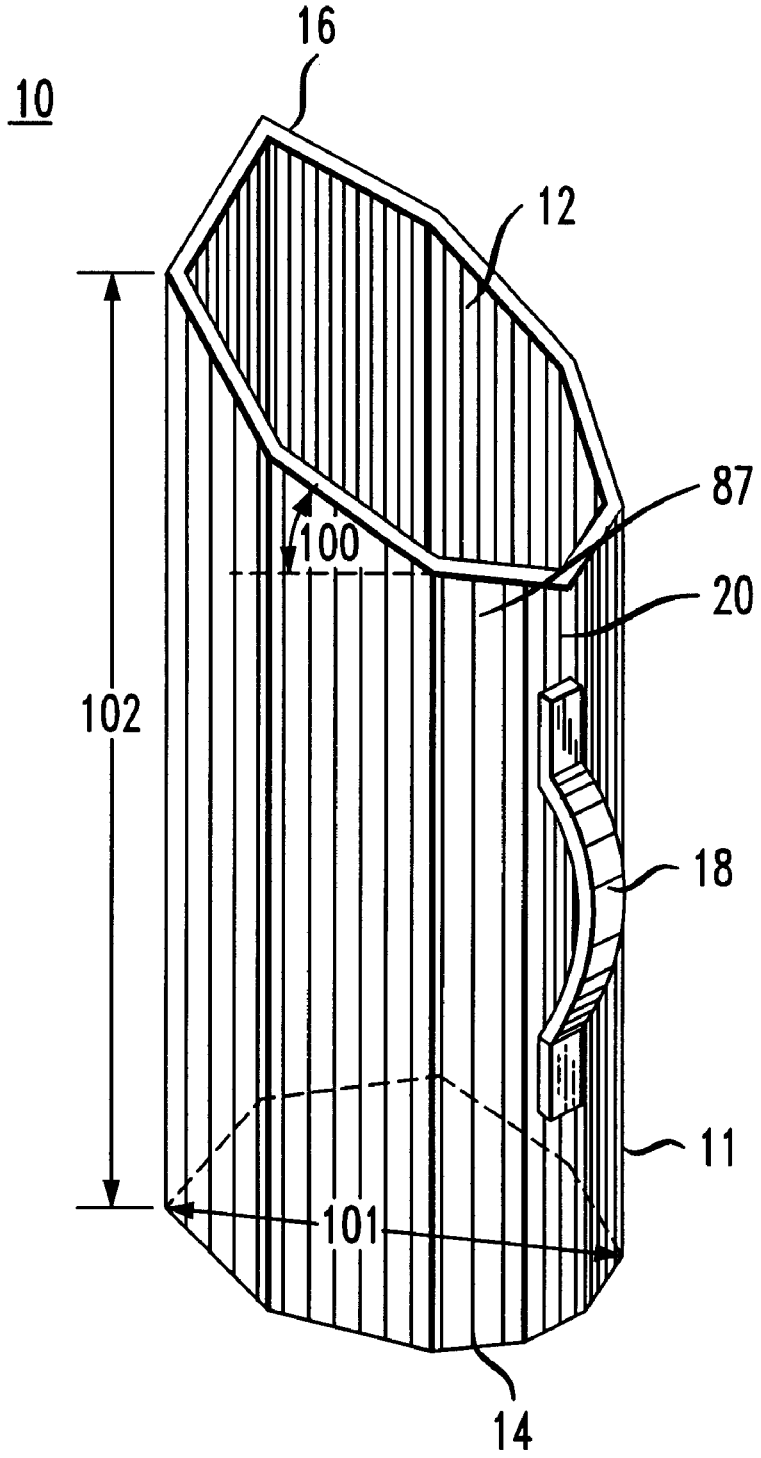
FIG. 1 is a perspective view of a preferred embodiment of the ice cube guide of the invention with its chute for collecting ice cubes from an ice dispenser compartment and directing them to exit outside of the ice dispenser compartment into an ice bucket, ice chest or other receptacle.

In FIG. 1, the ice cube guide 10 of the invention is in the substantial form of a tube having first and second open ends, 12, 14, with the end 12 having a forwardly facing edge 16, with the front end 12 forming the top opening of a chute 11 and with the second end 14 forming the bottom opening of the chute. With the chute 11 being fabricated of a rigid material (such as plastic or metal, for example), a handle 18 is shown, running lengthwise along the chute 11, on a outside surface thereof, as at 20, opposite the forwardly facing edge position 16. The front end (top opening 12) is shown as cut at an angle with respect to the horizontal, angled upwardly as at 100. Preferably, the cross-section 101 of the chute 11 so formed is of a dimension with respect to the hand-span of a user as to allow the chute 11 to be grasped in use, especially if the handle 18 were to be omitted. When used in a freezer door compartment of the order of 8" high by 11" wide by 4½" deep to collect ice cubes falling from the ice dispenser's opening and to direct them through the chute 11 to exit through the bottom opening 14, the angle 100 may be approximately 35°; the chute 11 may be of a length 102, 5–6 inches long, or longer.

Figure 2:
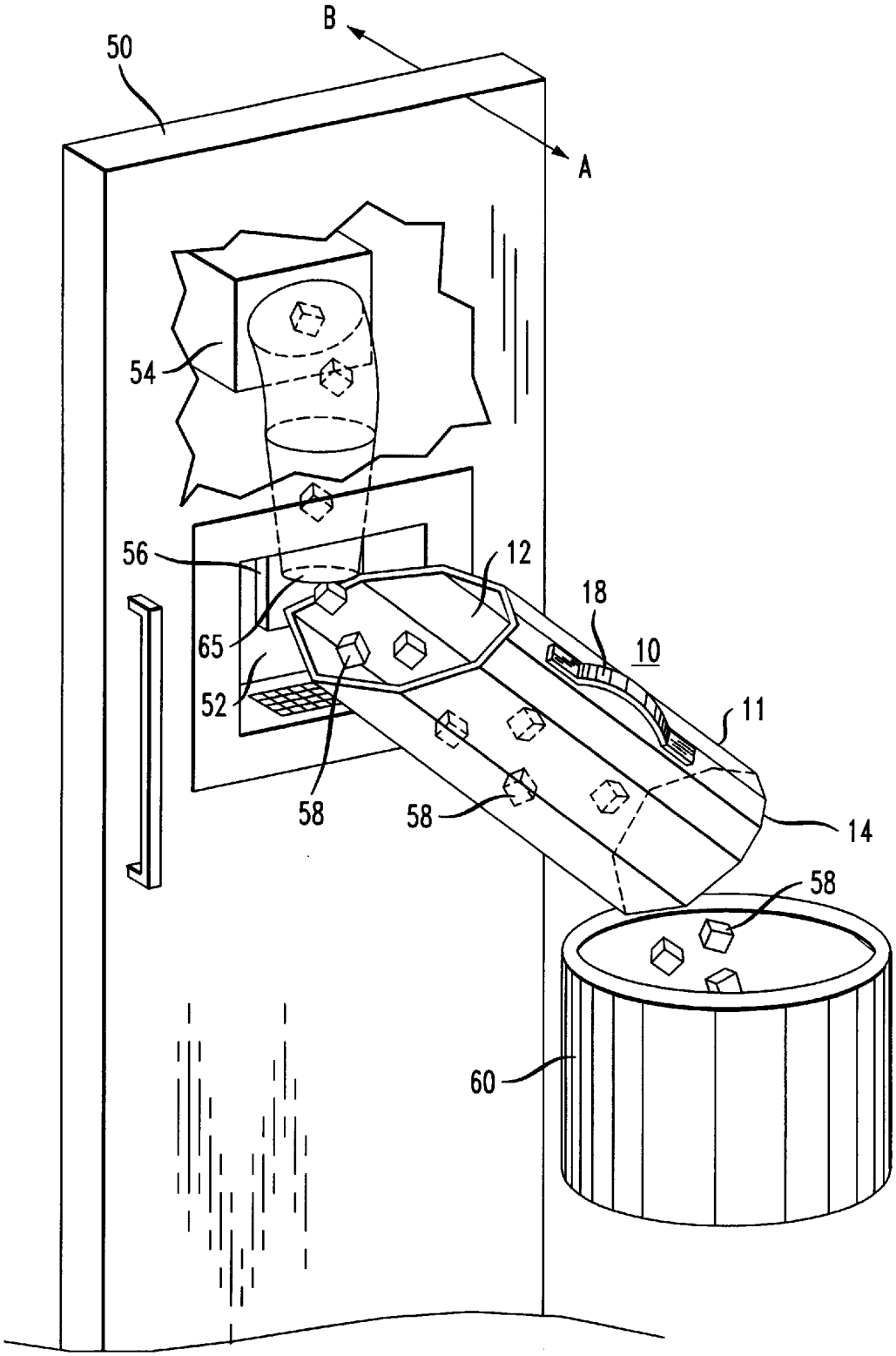
FIG. 2 is an illustration helpful in an understanding of the manner by which the ice cube guide of FIG. 1 may be utilized.

FIG. 2 illustrates how such an ice cube guide 10 may be employed in capturing ice cubes dispensed from the automatic ice cube maker for deposit into an ice bucket, ice chest, etc. of a size which prohibits its being placed (as a glass tumbler would, generally) within the compartment located on the freezer door. Such freezer door is shown at 50 in FIG. 2, with the arrow A understood to be pointing into the room in which the freezer sits, and with the arrow B pointing into the freezer compartment itself.

In FIG. 2, the ice dispensing compartment in the freezer door 50 is shown at 52, with the ice cube dispensing arrangement which fits under the ice cube storage bin in the freezer compartment of the refrigerator being shown at 54. The ice cubes to be dispensed upon actuating a button or lever operating mechanism 56 are shown at 58. Reference numeral 60 illustrates an ice bucket into which the dispensed ice cubes from the freezer compartment are to be gathered.

In particular, FIG. 2 illustrates the ice cube guide 10 with its handle 18 being angled so that the top opening 12 of the chute 11 fits below the point 65 at which the ice cubes are dispensed upon pressing the forward protruding edge 16 against the button or lever 56. The ice cubes 58 which then dispense from the opening 65 fall into the open top end 12, pass through the chute 11, and exit out the bottom opening 14 to drop into the ice bucket 60. With the construction of the chute 11 being of a rigid material—such as plastic or metal —, the chute can be grasped by the user even if the handle 18 were omitted, as long as the chute is oriented so that the protruding edge 16 actuates the button or lever 56 mechanism to dispense the ice cubes from the freezer compartment.

Figure 3:
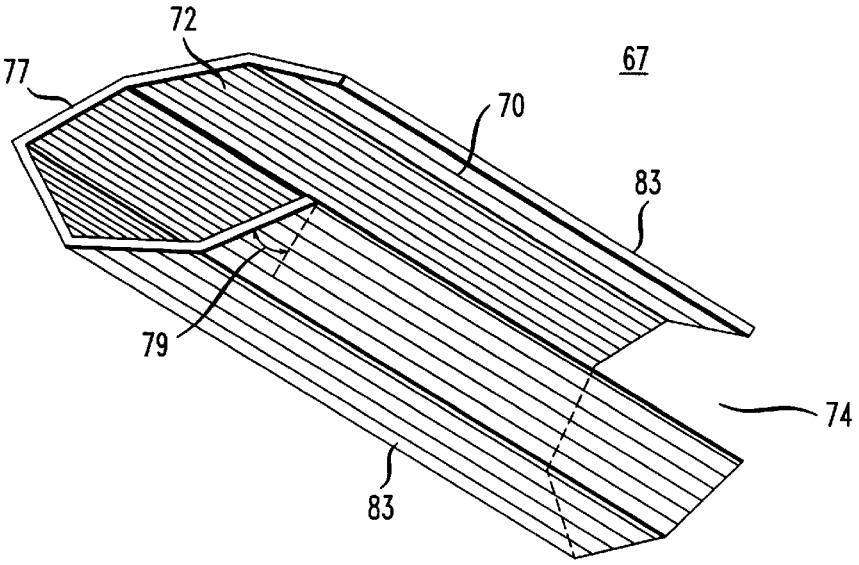
FIG. 3 is a perspective view of a second embodiment of the ice cube guide for use with refrigerator/freezer automatic ice cube makers according to the invention, employing a different collecting and directing chute.

FIG. 3 illustrates an alternate ice cube guide 67 according to the invention. The chute continues to be shown (as at 70) with an open top end 72 and an open bottom end 74, for collecting the dispensed ice cubes and passing them through the chute to the ice bucket or chest below. Such chute 70, however, differs from those of FIGS. 1 and 2 in its having open, discontinuous sides 83 along the length of the chute 70, as contrasted with the chute 11 of FIGS. 1 and 2 where the sides 87 are closed, and continuous along the length 102. With the handle 18 also removed from the arrangement of FIG. 3, the rigid construction of the chute 70 continues to allow it to be grasped by the user—and, particularly, in a manner such that its protruding front edge 77 will continue to actuate the operating button or lever 56 in the ice cube compartment. As with the embodiment of FIGS. 1 and 2, the angle 79 at the front end of the chute 70 permits the insertion of the open top 72 below the point at which the ice cubes are dispensed. In similar manner, this chute, also, may be of a length at least 5–6 inches long, of a cross-section dimension to be able to be grasped within the hand span of a user, and with the angle 79 cut to permit both a fitting of the front edge 77 below the dispensing mechanism and an actuation of it once in place.

Figure 4:
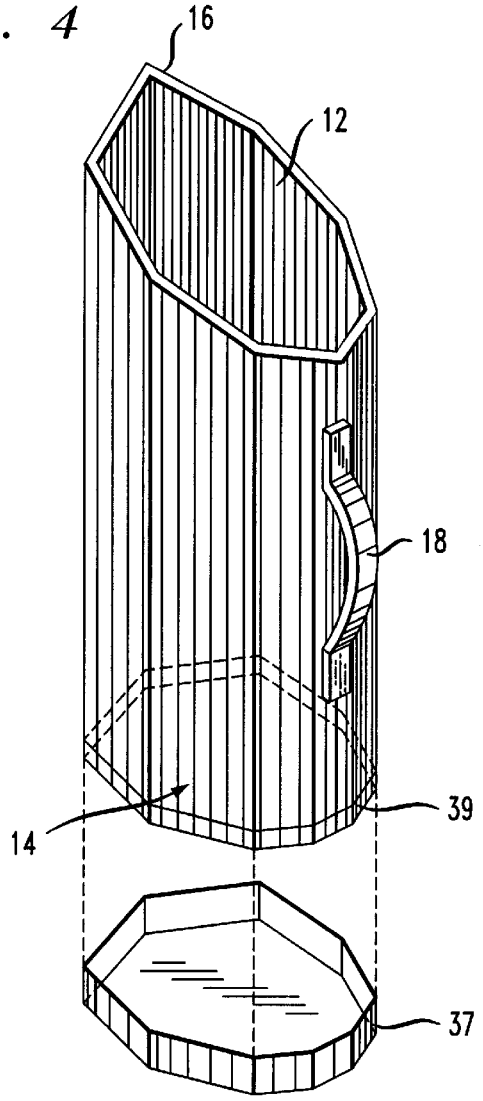
FIG. 4 shows a modified ice cube guide in accordance with the invention which allows the collected ice cubes to be temporarily retained.

While there have been described what are considered to be a preferred embodiments of the present invention, it will be readily appreciated by those skilled in the art that modifications can be made without departing from the scope of the teachings herein. For example, while the ice cube guide 10 of FIGS. 1 and 2 has been described as including a chute 11 with open top and bottom ends 12, 14, both the guide 10 and the guide 67 of FIG. 3 could also be dimensioned to receive a removable cover—37 in FIG. 4—, to couple about the bottom end of the chute (as at 39) in those uses where it might be desired to close off the chute to allow dispensed ice cubes to be temporarily collected and retained, and then transported to another room, or similar alternative location. For at least such reason, therefore, resort should be had to the claims appended hereto for a true understanding of the scope of the invention.

I claim:

1. An ice cube guide for use with refrigerator/freezer automatic ice cube makers of the type in which a press-actuation of a mechanism within an ice dispenser compartment dispenses ice cubes for use, comprising:

a hand-held chute having first and second opposite ends, and of a cross-section allowing removable insertion of said first end into said ice dispenser compartment a distance to extend said second end downwardly and rearwardly out from said compartment;

with said first and second ends of said chute being opened to permit the passage of ice cubes therebetween;

and with said first end of said chute being cut at an angle to situate said first end substantially below the point at which ice cubes are dispensed from said ice dispenser compartment;

whereby ice cubes falling from said ice dispenser compartment are captured by said first open end of said chute when inserted and directed through said chute to exit at said second open end of said chute outside of said ice dispenser compartment.

2. The ice cube guide of claim 1, wherein said hand-held chute includes a forwardly facing edge at said first end to contact said press-actuation mechanism when inserted into said compartment in actuating said mechanism to dispense ice cubes for use.

3. The ice cube guide of claim 2, wherein said cross-section of said hand-held chute is of a dimension with respect to the hand-span of a user to permit said chute to be grasped for use.

4. The ice cube guide of claim 2, wherein said hand-held chute includes a handle on an outside surface thereof, running lengthwise along said chute.

5. The ice cube guide of claim 4, wherein said handle is located on an outside surface of said hand-held chute rearwardly facing said chute and opposite to said forwardly facing edge at said first end.

6. The ice cube guide of claim 2, wherein said hand-held chute is fabricated of a rigid material, such as plastic or metal.

7. The ice cube guide of claim 2, wherein said hand-held chute is of a length of at least five-six inches.

8. The ice cube guide of claim 2, wherein said first end of said hand-held chute is cut at an angle of approximately 35° from a horizontal plane.

9. The ice cube guide of claim 2, wherein said hand-held chute is substantially in the form of a tube, having open opposite ends and closed, continuous sides along the length thereof.

10. The ice cube guide of claim 2, wherein said hand-held chute is substantially in the form of a tube, having open opposite ends and open, discontinuous sides along the length thereof.

11. The ice cube guide of claim 2, also including a cover for removably coupling to said second end of said hand-held chute.

* * * * *